United States Patent [19]

Kanada

[11] 4,293,753

[45] Oct. 6, 1981

[54] SWITCH

[75] Inventor: Hiroshi Kanada, Tsu, Japan

[73] Assignee: Matsushita Electric Works, Ltd., Osaka, Japan

[21] Appl. No.: 75,261

[22] Filed: Sep. 13, 1979

[30] Foreign Application Priority Data

Sep. 13, 1978 [JP] Japan ..... 53-113428

[51] Int. Cl.[3] ..... H01H 9/18

[52] U.S. Cl. ..... 200/315

[58] Field of Search ..... 200/310, 315, 311, 312, 200/313, 317, 212, 284

[56] References Cited

U.S. PATENT DOCUMENTS

| | | | |
|---|---|---|---|
| 2,841,673 | 7/1958 | Benander | 200/284 |
| 3,196,239 | 7/1965 | Maxted et al. | 200/315 |
| 3,215,806 | 11/1965 | Arnold et al. | 200/313 |
| 3,251,050 | 5/1966 | Given | 200/311 |
| 4,115,673 | 9/1978 | Smith | 200/315 |

FOREIGN PATENT DOCUMENTS

| | | | |
|---|---|---|---|
| 913845 | 12/1962 | United Kingdom | 200/310 |
| 1185463 | 3/1970 | United Kingdom | 200/315 |

*Primary Examiner*—John W. Shepperd

*Attorney, Agent, or Firm*—Burns, Doane, Swecker & Mathis

[57] ABSTRACT

A small and compact electric switch having therein means for indicating actuated state of an associated load and yet being simple and easy in interconnecting respective components and also in connecting them with said load and an electric source is provided. The switch has a transformer, the primary winding of which is connected to a switching means and to the source and load while the secondary winding is connected to a light emitting diode forming the indicating means which is enclosed in a rockable button actuating and switching means so that, when the switch is closed, a current is induced in the secondary winding to light the diode due to a source current flowing through the primary winding. Wires from the source and load are held as connected to the switching means by resilient connecting means which are accessible from the exterior for easy wire connection and disconnection.

4 Claims, 9 Drawing Figures

SWITCH

This invention relates to switches adapted to actuate an associated load circuit and to indicate actuated state of such circuit and, more particularly, to improvements in the switches having therein means for such indication. There is already suggested a switch formation wherein, in indicating the actuated state of the load circuit simultaneously with setting the switch on, the load circuit is connected in series with a current source through the switch and an indicating device is provided in parallel with the load circuit. However, in such formation the switch and indicating device are prepared respectively in separate blocks, wire connecting work between them is complicate, and these separate blocks of the switch and indicating device must be provided as combined with each other so that a procurement of space for them has been troublesome.

A primary object of the present invention is therefore, to provide a switch having the switching and indicating means wherein the internal wiring is easy, the wire connection of the current source and load circuit is compact and reliable and the durability is greatly improved. Another object of the present invention is to provide a switch performing both the switching and indicating functions wherein the wire connecting the work is remarkably simplified and the entire structure can be minimized in size.

FIG. 9 is a circuit diagram similar to FIG. 8 showing a state in which the switch is made on;

Figure 1:
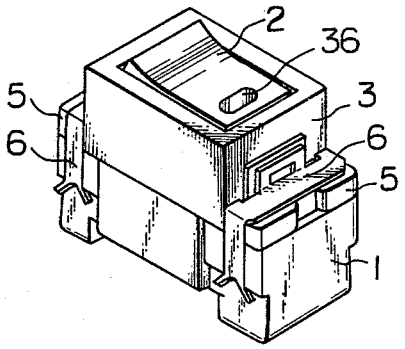
FIG. 1 is a perspective view of a switch according to the present invention as assembled.
Figure 2:
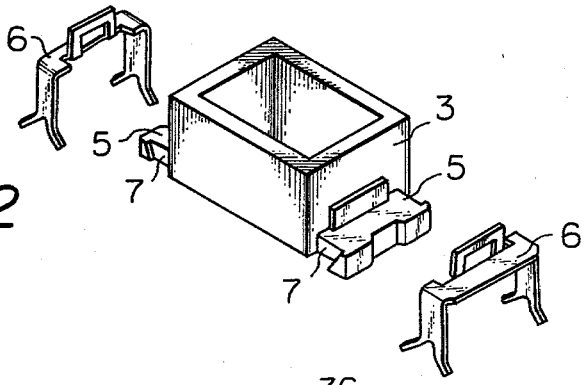
FIG. 2 is a perspective view of the switch shown in FIG. 1 as disassembled specifically at the upper part thereof.
Figure 2:
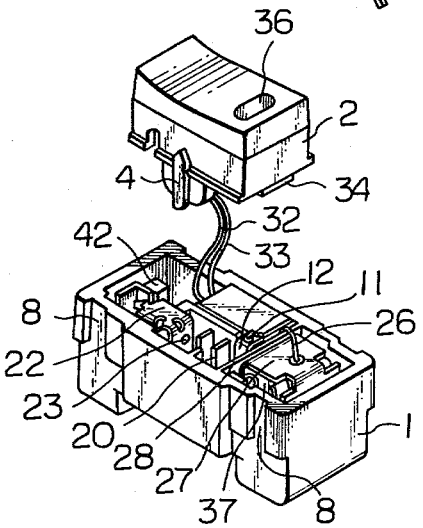

And referring now to FIG. 1, the switch according to the present invention generally comprises a body 1 on which a switch button 2 is rockably mounted. As shown in FIG. 2, the switch button 2 is enclosed in a cover member 3 in a hollow and rectangular boxy shape opened on the upper and lower sides and capable of abutting the upper edge of the body 1 as being prevented from moving in the horizontal directions. A fulcrum projection 4 is provided to project downward on each side surface (only one lateral side surface is shown) of the switch button 2 and these projections 4 are placed on the upper edge of the body 1 so that the switch button 2 may rock with the fulcrum projections 4 as a fulcrum within the cover member 3. Further, a lug 5 is provided on each longitudinal end surface of the rectangular cover member 3 to extend in opposite directions. A substantially U-shaped and resilient fastening band 6 is fitted from the upper side of the lug 5 into locking grooves 7 made on the lugs 5 as well as a locking slot 8 made in the respective side walls of the body 1 as aligned with the locking grooves 7. Respective locking parts at each free end of the fastening bands 6 are locked to the lower edges of projected wall parts of the body 1 defining the locking slots 8 to fasten the cover member 3 to the body 1. According to one feature of the present invention, there is used a transformer 9 in which the primary winding is connected to the switching circuit or load circuit and the secondary winding is connected to the indicating device, in order to render the wiring or wire connecting work for the indicating device housed in the switch body to be simpler. Referring to FIGS. 3 to 9, the transformer 9 is formed to be substantially of a thin rectangular parallelepiped shape so as to be housed in a large partitioned chamber 10 defined substantially centrally in the body 1. A conductive fulcrum member 12 which is substantially L-shaped as seen from a lateral side is connected to a lead wire 11 of the primary winding of the transformer 9. The upper end part 13 extending in the horizontal direction of the fulcrum member 12 is placed in a groove 15 of a partition wall 14 extending centrally in the lengthwise direction of the body 1, while the vertical part 16 and horizontal part 17 of the fulcrum member 12 reach a small partitioned chamber 18 defined adjacent the large partitioned chamber 10 in the width direction of the body 1 through the partition wall 14. The fulcrum member 12 is further provided at its lower end part with a horizontal part 17 in which an inverted V-shaped fulcrum part 9 projecting upward so as to contact the bottom surface of the small partitioned chamber 18. A U-shaped movable contact member 20 is mounted rockably in the lengthwise direction of the body 1 on the fulcrum part 19 of the fulcrum member 12. A movable contact 21 of this movable contact member 20 is made to contact a fixed contact 23 of a fixed contact member 22 when the fulcrum member 12 is caused to rock. The fixed contact member 22 itself is bent and formed to be rectangular so as to be fitted in a small connecting chamber 24 adjacent one side in the lengthwise direction of the small partitioned chamber 18. An arm part 25 bent to be L-shaped and to which the fixed contact 23 is fixed projects into the small partitioned chamber 18 over a small partition wall 25' between the small partitioned chamber 18 and the small connecting chamber 24. Therefore, one switching contact is formed of the movable contact 21 of the movable contact member 20 and the fixed contact 23 of the fixed contact member 22 without any wiring. On the other hand, another lead wire 26 of the primary winding of the transformer 9 is connected to a contacting member 27 which is inverted U-shaped as seen from the side. The contacting member 27 is provided so as to be fittable into a large connecting chamber 29 defined adjacent the other side in the lengthwise direction of the large partitioned chamber 10 and small partitioned chamber 18 through a partition wall 28 extending over the entire width in the width direction of the body 1. At this time, a bar-shaped projection 31 of the large connecting chamber 29 will be fitted into a slit 30 of one side plate part of the contacting member 27. When this contacting member 27 is fitted into the large connecting chamber 29, the contacting member 27 will be accurately positioned and fixed in the chamber 29.

According to another feature of the present invention, there is employed a formation wherein a luminous diode having a semi-permanent life and lower in the electric power consumption substantially as compared with neon lamps or the like is used instead of the neon lamp or the like which is short in the life, so as to remarkably improve the durability and to save energy. Referring again to FIGS. 2 and 6, lead wires 32 and 33 of the secondary wiring of the transformer 9 are connected to a base plate 34 for a printed circuit and secured to the lower edge of the switch button 2. A luminous diode 35 connected to the secondary wiring of the transformer 9 are connected to a base plate 34 for a printed circuit and secured to the lower edge of the switch button 2. A luminous diode 35 connected to the secondary winding through the printed circuit (not shown) optimumly prepared on the plate 34 is provided to erect on the base plate 35 as arranged to be positioned just below or inside a light-permeable plate 36 fitted to the switch buttom 2 so that a light emitted by the diode can be seen through the light-permeable plate 36. Further, according to another feature of the present invention, the switch having the indicating device housed therein employs a formation wherein a current source and load circuit can be connected in a very simple manner with each other. That is, the perspective connecting wires from the current source and load circuit can be smoothyl or easily housed in the body whereas they can be positively prevented by a wedge action from being readily disconnected and can be urged into a reliable contact with the fixed contact member or the contacting member. Referring again to FIGS. 3 and 6, there are arranged a single connecting spring 37 for the fixed contact member 22 and a pair of springs 37 for the contacting member 27. The respective connecting springs 37 are made to have a diagonally upward extending wedge part 38 provided to extend from the lower part and is doubly curved in the upper part to form a pressing part 39. Therefore, the wedge part 38 extends toward the inside surface of the fixed contact member 22 or the contacting member 27 so as to render an insertion of the connecting wires to be easier, and performs such wedge action as biting at the tip into the connecting wires so as to prevent them from being disconnected when the connecting wires are pulled. Further, the connecting wires inserted between the respective inside surfaces of the fixed contact member 22 and the contacting member 27 are urged to be resiliently pressed against the inside surfaces of the respective members 22 and 27 by the respective pressing parts 39. In this case, the clearances between the inside surfaces of the fixed contact member 22 and contacting member 27 and the operating ends of the connecting springs 37 are so provided as to be positioned respectively above a connecting hole 40 made in one end part of the bottom surface of the body 1 and a pair of connecting holes 41 made in the other end part of the bottom surface so that the connecting wires can be inserted into the body upward through these connecting holes 40 and 41.

Figure 3:
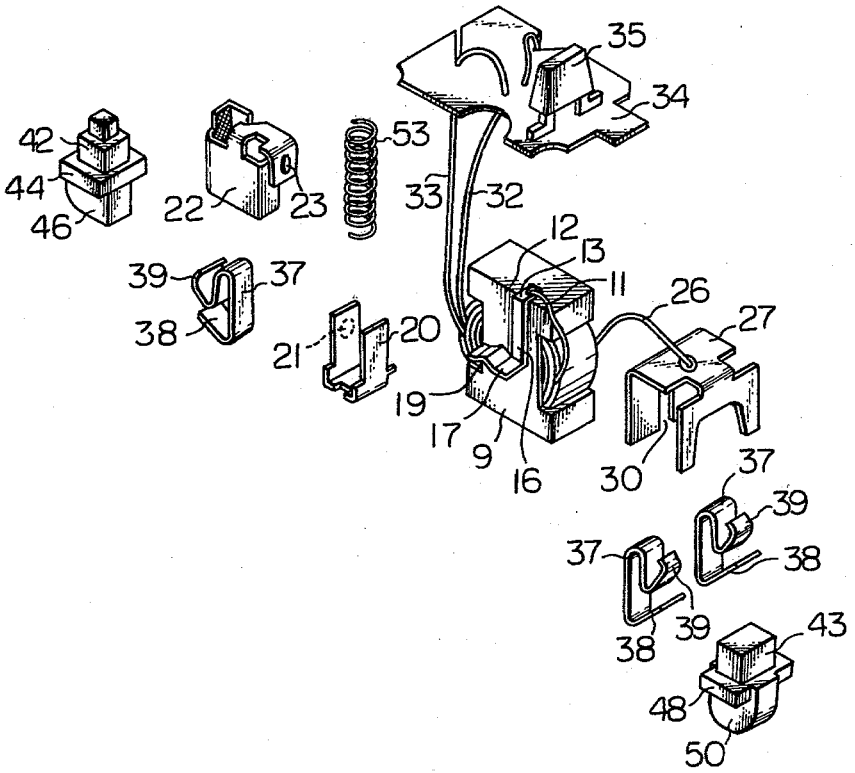
FIG. 3 is a perspective view as disassembled of respective components arranged within a body and switch bottom of the switch shown in FIG. 1.
Figure 4:
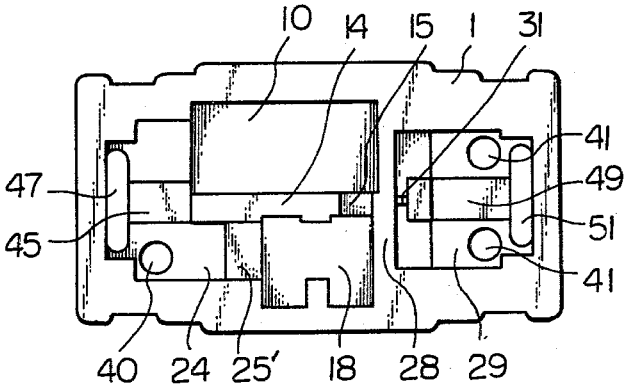
FIG. 4 is a plan view of the body of the switch according to the present invention.
Figure 5:
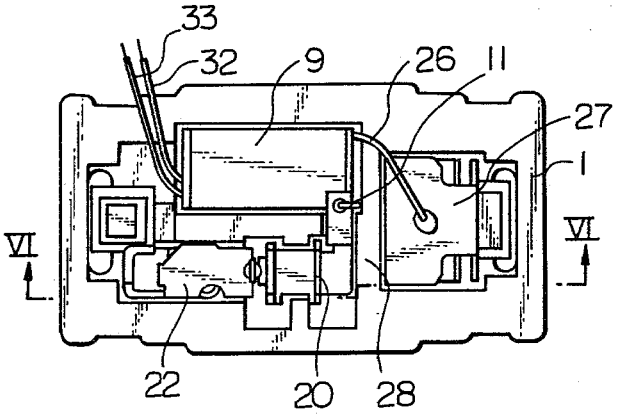
FIG. 5 is a plan view of the body of FIG. 4 with the respective components arranged therein.
Figure 6:
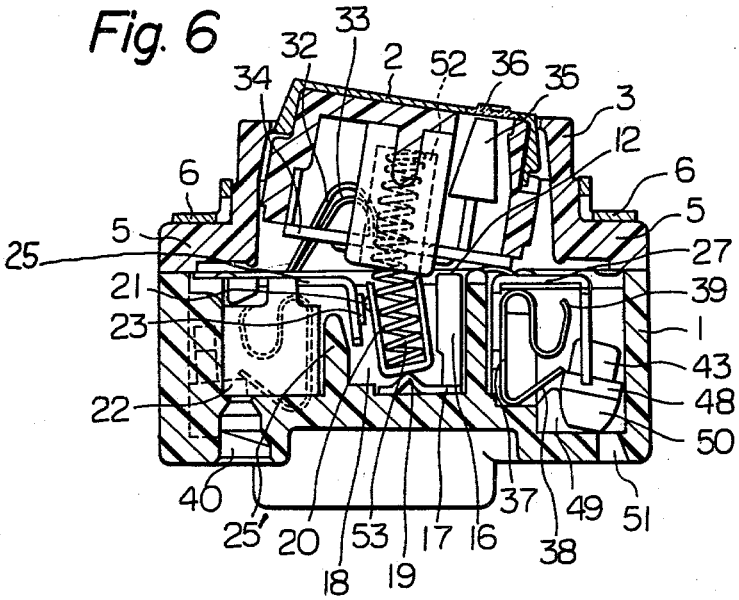
FIG. 6 is a vertically sectioned view along line VI—VI in FIG. 5 of the switch according to the present invention with all the components as assembled.
Figure 7:
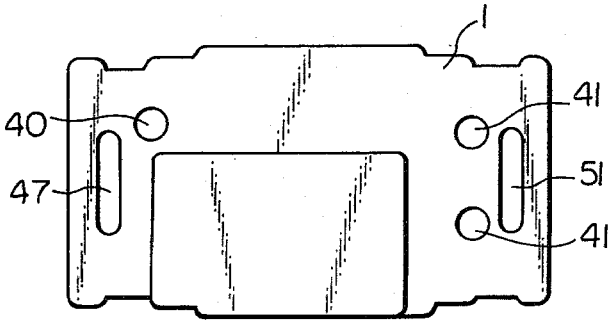
FIG. 7 is a bottom view of the body of FIG. 4.
Figure 8:
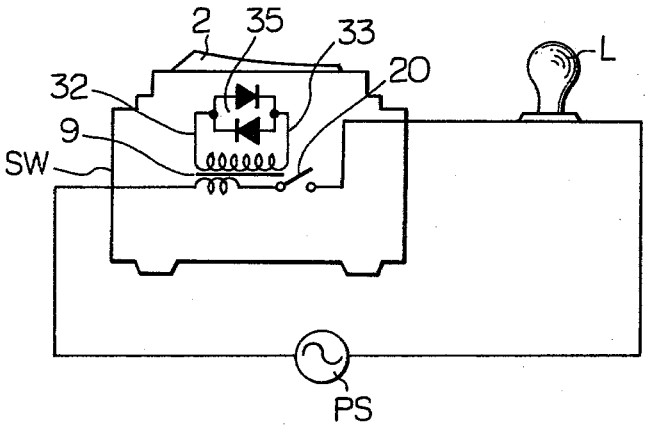
FIG. 8 is a schematic circuit diagram in which a load is connected to a current source and the switch according to the present invention, showing a state in which the switch is made off.
Figure 9:
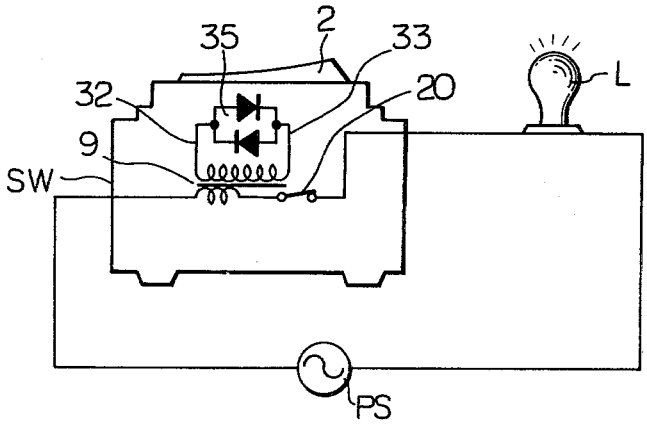

According to still another feature of the present invention, there is employed a formation wherein the connecting wires from the current source and load circuit wedged by the connecting springs 37 can be released by slightly displacing these connecting springs 37. For this purpose, referring to FIGS. 3, 6 and 7, first and second releasing members 42 and 43 are arranged so as to be able to act on the connecting springs 37. A locking part 44 contactable with the wedge part 38 of the single connecting spring 37 is provided as expanded in the horizontal direction in the first releasing member 42. Another locking part 46 of the first releasing member 42 for freely fitting in a guide cavity 45 defined in the one end part of the bottom surface of the body 1 adjacent the connecting hole 40 is formed immediately below the locking part 44. One side end surface of this locking part 46 is curved toward the bottom surface on the longitudinal end side of the body 1 as seen in FIG. 3. This curved surface is arranged so as to be positioned above a releasing slot 47 made in the width direction also in the one end part of the bottom surface of the body 1 adjacent the guide cavity 45. In the second releasing member 43, a locking part 48 contactable simultaneously with the respective wedge parts 38 of the pair of connecting springs 37 is provided as expanded in the horizontal direction. This second releasing member 43 is also provided below the locking part 48 with a locking part 50 for freely fitting in a guide cavity 49 defined between the pair of connecting holes 41 in the other end part of the bottom surface of the body 1. Both side end surface of this locking part 50 are curved toward the bottom surface as seen in FIG. 3, and one of these curved side end surfaces is so arranged as to be positioned above a releasing slot 51 made in the width direction in the other end part of the body 1 and adjacent the guide cavity 49. In addition, as best seen in FIGS. 3 and 6, a coil spring 53 inserted substantially by half its length in a spring receiving cavity 52 formed in the switch button 2 is butted at the lower end against the inner bottom surface of the U-shaped movable contact member 20 placed on the fulcrum part 19. When the switch button 2 rocks, the coil spring 53 will bend substantially in the middle in the direction reverse to the rocking direction of the switch button 2 and will cause the movable contact member 20 to rock in the bending direction of the spring 53. In this case, the curved coil spring 53 will displace also the spring receiving cavity 52 simultaneously with the movable contact member 20 so as to be directed in the bending direction of the coil spring and will be maintained in the same bending state and, therefore, the movable contact member 20 will be kept in the displaced position. Referring now to FIGS. 8 and 9 in conjunction with FIGS. 6 and 7, the operation of the switch according to the present invention shall be detailed. Now, the connecting wire from a load L is inserted between the inside surface of the fixed contact member 22 and the acting end of the contact member 37 through the connecting hole 40 and the connecting wire from the current source PS is inserted between the inside surface of the contacting member 27 and the acting end of the connecting member 37 through the connecting hole 41. In this state, when the switch button 2 is rocked clockwise in FIG. 6 with respect to the body 1, the coil spring 53 between the switch button 2 and movable contact member 20 will bend to the left side from the vertical plane including the fulcrum part 19 and, by this displacement of the coil spring 53, the movable contact member 20 will be inclined to the side of the fixed contact member 22 on the fulcrum part 19. Therefore, the movable contact 21 will be made to contact the fixed contact 23 and the switch's opened state of FIG. 8 will shift to the closed state of FIG. 9. That is, a circuit will be formed through the contacting member 27 connected to the current source PS, primary coil of the transformer 9, contact member 12, movable contact member 20 and fixed contact member 22 connected with the connecting wire from the load L. When this circuit is formed, an electric current will be induced in the secondary winding of the transformer 9 and the luminous diode 35 will be made to emit light to indicate the actuation of the load. Therefore, by only connecting the respective lead wires of the primary and secondary windings of the transformer 9 to the fulcrum member 12, contacting member 27 and printed base plate 34, the wiring within the switch can be completed, the wire connecting work can be simplified and the wiring can be made simpler. Also, the current source and load circuit can be very easily connected with each other by only inserting the connecting wires. In FIG. 6, when the switch button 2 is rocked counterclockwise, the coil spring 53 will bend to the right side from the vertical plane including the fulcrum part 19 and the movable contact member 20 will incline to the other side of the contacting member 27 on the fulcrum part 19.

Therefore, the position in which the movable contact 21 separates from the fixed contact 23, the movable contact member 20 separates from the fixed contact 23, the movable contact member 20 will stop and the contacts will be opened. In this case, the movable contact member 20 will be held in the displaced position by the coil spring 53. Further, in this case, the connecting wires from the current source and load circuit are urged to about against the inside surfaces of the fixed contact member 22 and contacting member 27 by the pressing parts 39 of the connecting springs 37 and the connection of these connecting wire and inside surface with each other will be well maintained. By the wedge part 38 which pushing up the connecting wire with respect to the inside surface so as to thus perform a wedge action, the connecting wire will be positively prevented from being pulled out. In this case, it is preferable that contacting parts of the inside surfaces of the fixed contact member 22 and contacting member 27 with the connecting wires are made rought surfaces to increase friction. On the other hand, in releasing the connecting wires from the current source and load circuit, a proper tool is inserted through the releasing slots 47 and 51 to depress the locking parts 46 and 50 of the releasing members 42 and 43, then the releasing members 42 and 43 will be displaced respectively toward the connecting springs 37 and therefore the locking parts 44 and 48 of the releasing members 42 and 43 will act to separate the wedge parts 38 of the connecting springs 37 from the inside surfaces of the fixed contact member 22 and contacting member 27. In this state, the connecting wires can be easily pulled out to perform the disconnection of them in a simple manner.

What is claimed is:

1. A switch for indicating an activated condition of a load circuit, said switch comprising:

a body including first, second, third, and fourth chambers, said first and second chambers disposed adjacent one another in a widthwise direction of said body, and said third and fourth chambers disposed at opposite lengthwise ends of said first and second chambers, said second and third chambers being separated by a partition, a transformer disposed in said first chamber and including primary and secondary windings, a conductive fulcrum member connected to one lead of said primary winding and forming a fulcrum disposed in said second chamber, a movable contact member carrying a movable contact and rockably supported on said fulcrum for rocking movement to either side thereof, a first spring for yieldably retaining said movable contact member in position, a fixed contact member disposed in said third chamber and carrying a fixed contact, said fixed contact member extending over said partition to locate said fixed contact in said second chamber for being contacted by said movable contact, a contacting element connected to another lead of said primary winding and disposed in said fourth chamber, second springs disposed in said third and fourth chambers, respectively, on opposite sides of said fulcrum and in opposing relation to said fixed contact member and contacting element, said second springs each including a wedge portion and arranged to urge an exterior load connecting wire against said fixed contact member and contacting element, respectively, a switch button rockably mounted on said body and resiliently abutting said first spring, and a light emitting diode connected to said secondary winding and being housed visibly within said button to provide a visual indication when the load circuit is activated.

2. A switch according to claim 1, wherein said button includes a transparent plate, a printed circuit board mounted to the underside of said button and connected to said secondary winding, said diode being mounted as said circuit board beneath said transparent plate.

3. A switch according to claim 1 including releasing members disposed adjacent said second springs, said releasing members being movable into engagement with said wedge parts of said second springs in response to an external operating force, to release said load connecting wires.

4. A switch according to claim 1, wherein said first spring is housed within said movable contact member.

* * * * *